US010996707B2

(12) United States Patent
Seelig et al.

(10) Patent No.: US 10,996,707 B2
(45) Date of Patent: May 4, 2021

(54) FOOT SWITCH

(71) Applicant: STEUTE TECHNOLOGIES GMBH & CO. KG, Löhne (DE)

(72) Inventors: Uwe Seelig, Bad Münder (DE); Rainer Flachmann, Porta Westfalica (DE); Christof Gerhardy, Bad Oeynhausen (DE); Marc Schmidt, Hiddenhausen (DE)

(73) Assignee: STEUTE TECHNOLOGIES GMBH & CO. KG, Löhne (DE)

( * ) Notice: Subject to any disclaimer, the term of this patent is extended or adjusted under 35 U.S.C. 154(b) by 0 days.

(21) Appl. No.: 16/968,204

(22) PCT Filed: Feb. 8, 2019

(86) PCT No.: PCT/EP2019/053175
§ 371 (c)(1),
(2) Date: Aug. 7, 2020

(87) PCT Pub. No.: WO2019/155006
PCT Pub. Date: Aug. 15, 2019

(65) Prior Publication Data

US 2021/0026392 A1 Jan. 28, 2021

(30) Foreign Application Priority Data

Feb. 9, 2018 (DE) ..... 20 2018 100 723.8

(51) Int. Cl.
*G05G 1/44* (2008.04)
*G05G 5/04* (2006.01)

(52) U.S. Cl.
CPC ..... *G05G 1/44* (2013.01); *G05G 5/04* (2013.01)

(58) Field of Classification Search
CPC ..... G05G 1/44; G05G 5/04
See application file for complete search history.

(56) References Cited

U.S. PATENT DOCUMENTS 3,833,782 A 9/1974 Bartel
4,965,417 A * 10/1990 Massie ..... H01H 21/26 200/86.5
6,360,630 B2 * 3/2002 Holtorf ..... G05G 1/30 200/86.5

(Continued)

FOREIGN PATENT DOCUMENTS

EP 3444699 A1 2/2019
WO 03023544 A2 3/2003

(Continued)

OTHER PUBLICATIONS

International Search Report dated May 20, 2019 in related/corresponding International Application No. PCT/EP2019/053175.

(Continued)

*Primary Examiner* — Vicky A Johnson
(74) *Attorney, Agent, or Firm* — Patent Portfolio Builders PLLC

(57) ABSTRACT

A foot switch includes at least one pedal rotationally mounted for actuating about at least two axes arranged at an angle with respect to each other. A stop device that can stop a movement of the pedal about one of the two axes is provided.

7 Claims, 3 Drawing Sheets

(56) References Cited

U.S. PATENT DOCUMENTS

2004/0035242 A1* 2/2004 Peterson ..... G05G 1/30
74/560
2019/0004559 A1* 1/2019 Gahler ..... G05G 1/483

FOREIGN PATENT DOCUMENTS

WO 2010054146 A1 5/2010
WO 2014172550 A1 10/2014

OTHER PUBLICATIONS

Search Report created on Nov. 22, 2018 in related/corresponding DE Application No. 20 2018 100 723.8.
Written Opinion dated May 20, 2019 in related/corresponding International Application No. PCT/EP2019/053175.

* cited by examiner

FOOT SWITCH

BACKGROUND AND SUMMARY OF THE INVENTION

Exemplary embodiments of the invention relate to a foot switch having at least one pedal pivotally mounted for actuation about at least two axes arranged at an angle with respect to each other.

Foot switches with one or more pedals are used in many areas. They are usually designed to close or open an electric circuit following a rocking movement of a human foot. In the medical field in particular, switches usually have a pedal, among other things, with which one or more circuits can be switched on or off or signals can be provided, the type and/or strength of which depend on the current position of the pedal. There are switches with a pedal that can only be moved around one axis, or one that can be moved around several axes, wherein the switched circuits or the signals emitted depend, among other things, on the direction of actuation of the pedal.

For example, the publication WO 03/023544 describes a foot switch for a surgical instrument where the user can operate the pedal in both vertical and horizontal directions. The deflection of the pedal in the respective direction is detected by output signal generators, for example by potentiometers or optical rotation/displacement sensors. As a special feature, the foot switch has a switchable mechanism that generates predetermined pressure points for the vertical movement, providing the operator with feedback on the actuation.

However, for certain applications or by some users, foot switches with pedals that can only be moved around one axis are preferred, accepting the smaller number of controllable functions. The publication WO 2014/172550A1 describes such a switch, in which case the pedal can only be moved vertically.

This now leads to the disadvantageous situation that a supplier or operator of pedal-controlled devices must have foot switches of different designs for the different operating modes.

Accordingly, exemplary embodiments of the invention are directed to a foot switch suitable for both operating modes.

A foot switch according to the invention and of the type mentioned above includes a locking device that arrests movement of the pedal about one of the two axes. In this way a foot switch can be used in both desired operating modes. A foot switch manufacturer or a supplier of the equipment to be controlled need only keep one type of foot switch and can configure it according to the user's preference. It may also be provided that a user himself or herself chooses or switches between the two operating modes.

In an advantageous design, the foot switch has a pedal base body that is mounted so as to be pivotable about a horizontal axis, and a pedal pivot body that is mounted opposite the pedal base body so as to be pivotable about an axis perpendicular to the pedal base body. Thus, two directions of movement of the pedal can be realized, which are separated from each other in that one axis is assigned to each direction of movement. Accordingly, selective locking of one of the two directions of movement can be easily implemented, for example by the locking device acting on the pivoting movement of the pedal pivot body relative to the pedal base body.

The locking device can be manually operated in one design of the foot switch. For this purpose, it may preferably have at least one hand lever coupled to at least one locking pin, wherein the locking pin blocks the pivoting movement of the pedal pivot body in a locking position and enables the pivoting movement in a release position. For example, the at least one locking pin can be retracted into a locking pin chamber of the pedal pivot body in the release position and can be extended from the locking pin chamber in the locking position to such an extent that it acts as a stop opposite the pedal base body. Preferably, two locking pins are provided and arranged in such a way that, in the locking position, they rest laterally against one side of the pedal body.

In another advantageous design of the foot switch, the locking device is designed to be controllable. It can thus be controlled, for example, from the pedal-controlled device to which the foot switch is coupled or from a separate remote control. When controlled from the pedal-controlled device, an automatic default locking state can be set, e.g., depending on the user and/or application. In order to avoid malfunctions or operating errors, it is useful, for example, if the functions and function assignments of the controlled device and the respective switch operating mode automatically adapt to each other. In all cases, a connection between the foot switch and the controlled device can be wired or wireless.

In order to be controllable, the locking device preferably has an actuator with which a locking element can be moved into a locking position and a release position. The locking element can be a locking piston in one design. The actuator moves the locking element, for example electromagnetically or by electric motor.

In another advantageous design, the foot switch has a sensor arrangement to detect a locking state. This allows the functionality of the device controlled by the foot switch to be adapted to the operating mode of the foot switch. This applies in particular if the operating mode of the foot switch can be switched manually or via remote control. However, even if a default locking state is set by the device to be controlled, it can be useful to detect the locking state in order to compare the (actual) locking state with the default locking state and thus to be able to check a controllable locking device for correct functioning. The sensor arrangement can include, for example, a permanent magnet and a reed switch. Alternatively, test contacts can also be used and/or optical position detection of components of the locking device, e.g., locking pins or locking pistons, can be carried out.

BRIEF DESCRIPTION OF THE DRAWING FIGURES

The invention is explained in more detail below using two embodiment examples with the aid of figures, which show as follows.

DETAILED DESCRIPTION

Figure 1:
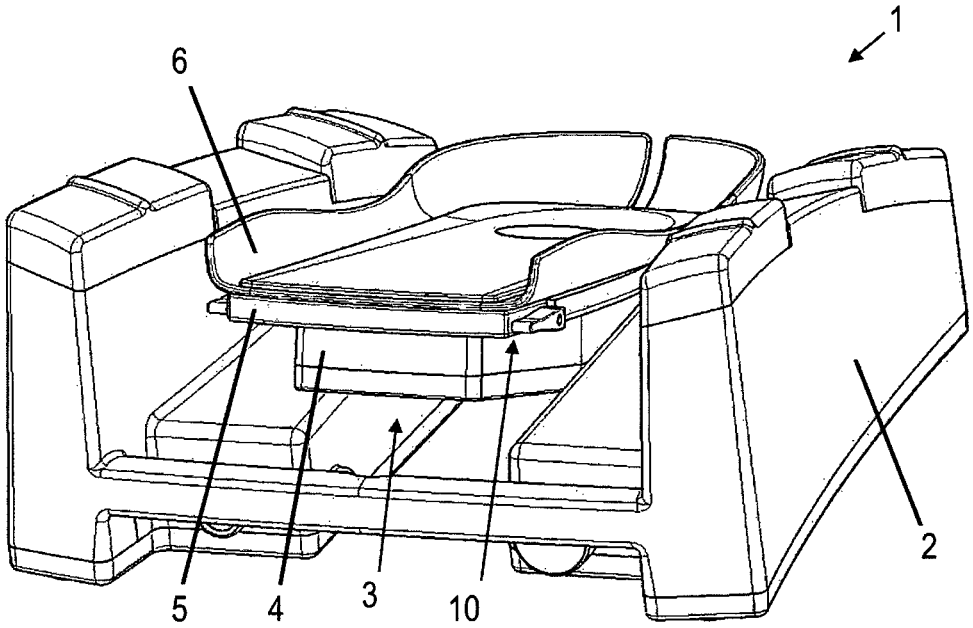
FIG. 1 shows a perspective view of a foot switch according to the invention with a manually operated locking device as a first embodiment example.

FIG. 1 shows a foot switch 1 with a housing assembly 2 and a pedal assembly 3 as the first embodiment example. A pedal base body 4 belonging to pedal assembly 3 is mounted in housing assembly 2 in such a way that pedal assembly 3 can be moved (pivoted) in the vertical direction about a horizontal axis of rotation. A pedal pivot body 5 also belonging to pedal assembly 3 is mounted on the pedal base body 4 in such a way that the pedal pivot body 5 can be moved (pivoted) in the horizontal direction about an axis essentially perpendicular to the horizontal axis of rotation of the pedal assembly, to the top side of the pedal base body 4 and to the bottom side of the pedal pivot body 5. In the example shown, a bowl-shaped foot rest 6 is arranged on the pedal pivot body 5, on which a user places his foot to operate the foot switch 1.

The pedal pivot body 5 and the foot rest 6 together form a pedal of the foot switch 1, which is mounted so that it can move in two independent directions of movement. The foot switch 1 is thus designed as a multi-way pedal switch that can detect movements of an actuating foot in the two independent directions of movement, in the example specifically a pivoting movement about a horizontal pivot axis and a pivoting movement about an essentially vertical pivot axis.

According to the invention, a locking device 10 is provided with which one of the two movement possibilities of the foot switch 1 can be locked.

In the first embodiment example, which is shown in FIGS. 1 to 4, the locking device 10 is designed as a manually operated arrangement. Here the locking device 10 comprises two hand levers 11 pivotally mounted on a common connecting shaft, not visible here, on the pedal pivot body 5. Two locking pins 12 are coupled to the connecting shaft and thus to the hand levers 11. They are arranged in a position of the hand levers 11 in locking pin chambers 13 inside the pedal pivot body 5. In this position, which is shown in FIG. 1, they do not influence the pivoting of the pedal pivot body 5 in relation to the pedal base body 4. This position is therefore also referred to as the release position.

By actuating the hand levers 11 into a so-called locking position, the locking pins 12 extend from the locking pin chambers 13 and lock the pedal pivot body 5 in a central position relative to the pedal base body 4. Horizontal movement of the pedal pivot body 5 is blocked in this locking position and is thus not possible. The locked position is shown in FIG. 2, which shows pedal assembly 3 from an angle below.

Figure 2:
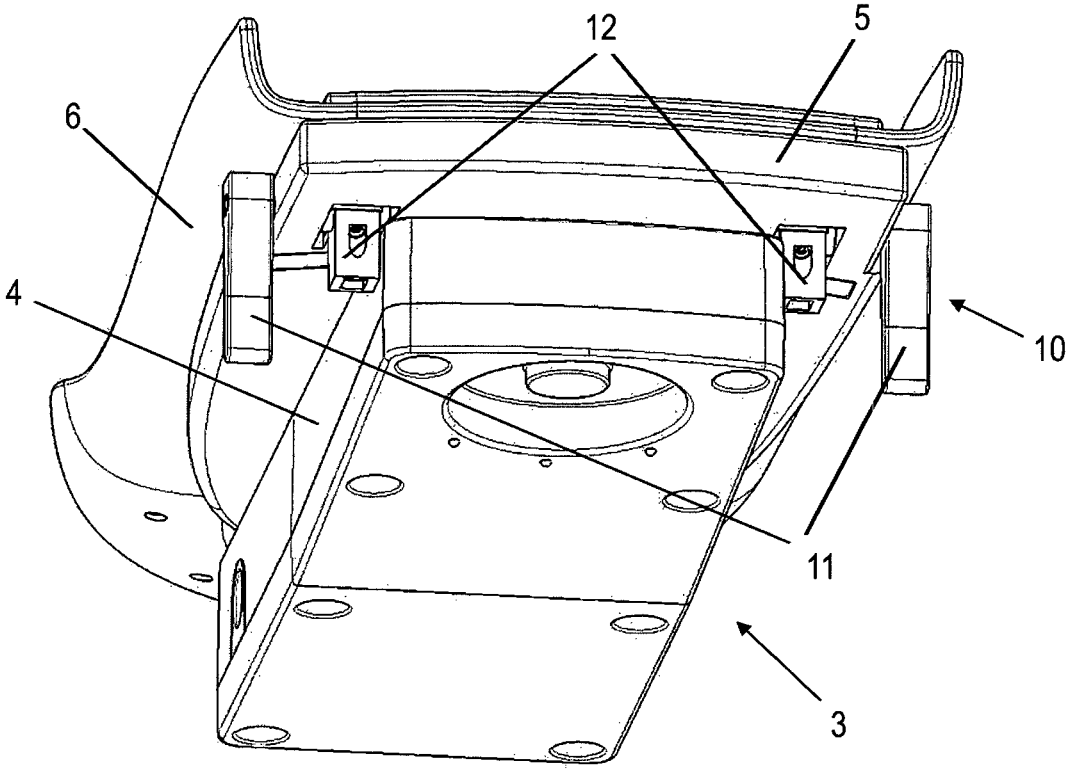
FIG. 2 shows a perspective partial view of the foot switch as shown in FIG. 1 with locked horizontal movement.
Figure 3:
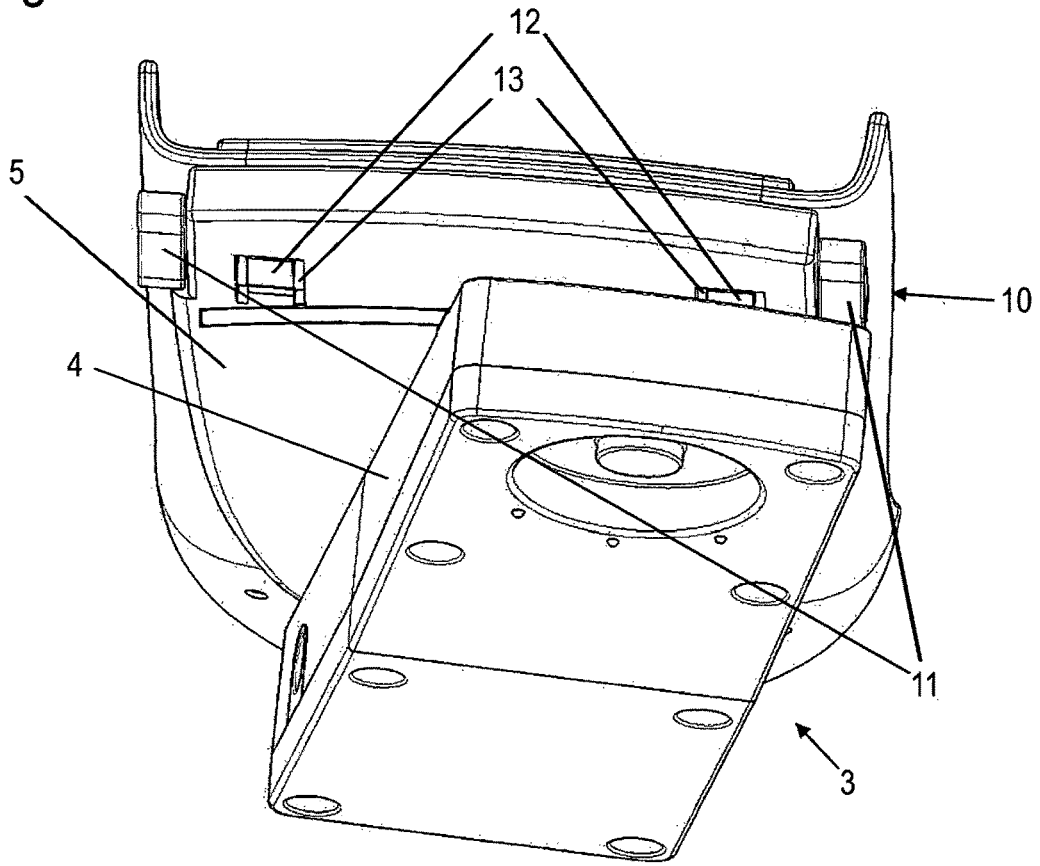
FIG. 3 shows a perspective partial view of the foot switch as shown in FIG. 1 with released horizontal movement in a horizontally operated state.

FIG. 3 shows the pedal assembly 3 in a similar view to FIG. 2. The locking device 10 is shown here again in the release position, in which the hand levers 11 are turned to an upper stop and the locking pins 12 thus rest in the locking pin chambers 13 of the pedal pivot body 5. The locking device 10 is held in this position by one or more resilient elements not shown here, which are attached to the pedal pivoting body 5 or integrally formed therewith and which interact with suitably designed latching contours not shown here.

Figure 4:
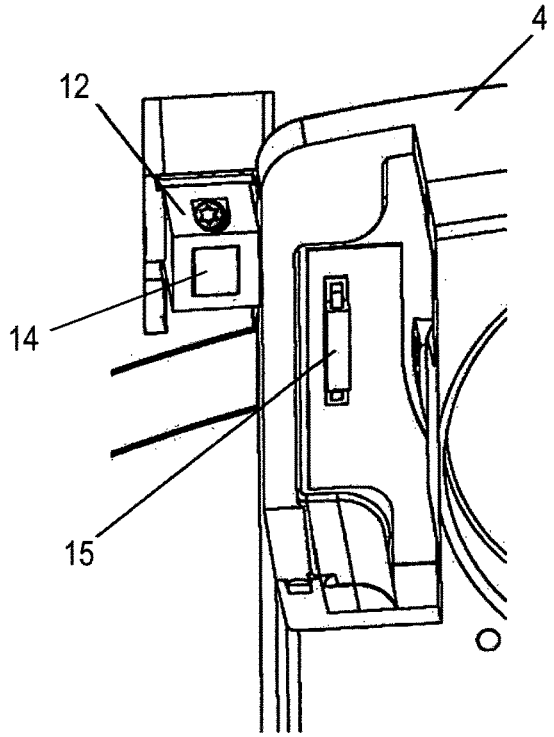
FIG. 4 shows a perspective partial section of the foot switch as shown in FIG. 2, showing the sensor elements for signaling the locking state.

FIG. 4 shows a further development of the first embodiment example. In this example, a sensor arrangement is provided for detecting and signaling the locking state. For this purpose, a permanent magnet 14 is arranged within one of the locking pins 12 and a reed switch 15 is arranged in the pedal base body 4. The reed switch 15 is actuated depending on the locking state (release position or locked position). The switching state of the reed switch 15 is thus characteristic of the locking state and can be processed as a signal by the controlled device.

Figure 5:
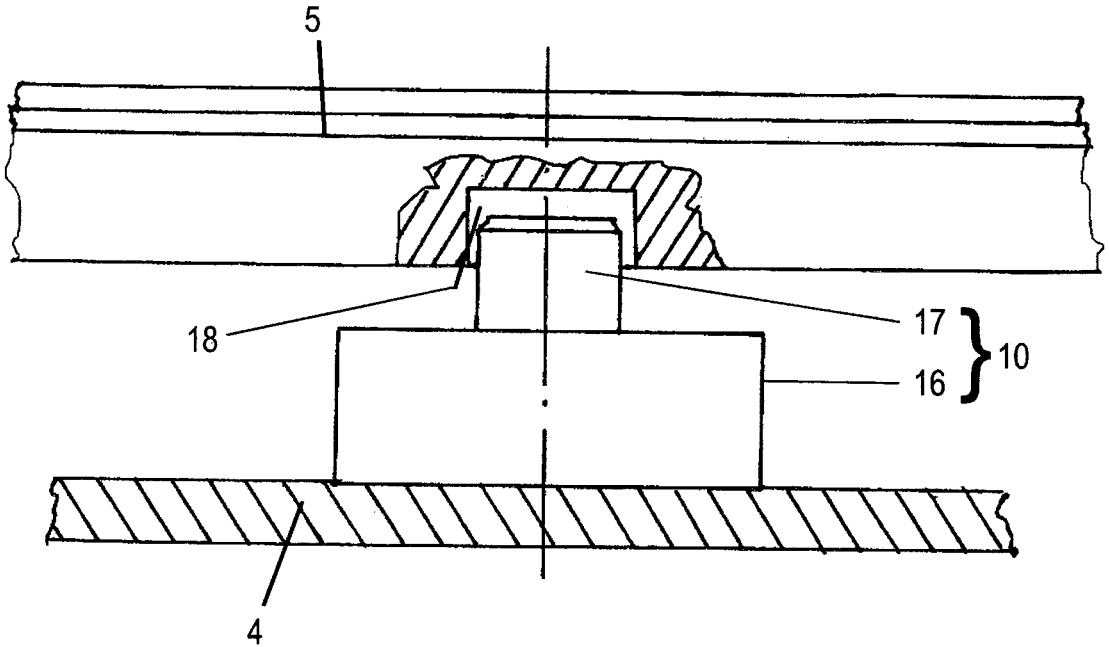
FIG. 5 shows in a schematic diagram a partial section through a foot switch according to the invention for remote-controlled actuation as a second embodiment example with locked horizontal movement.
Figure 6:
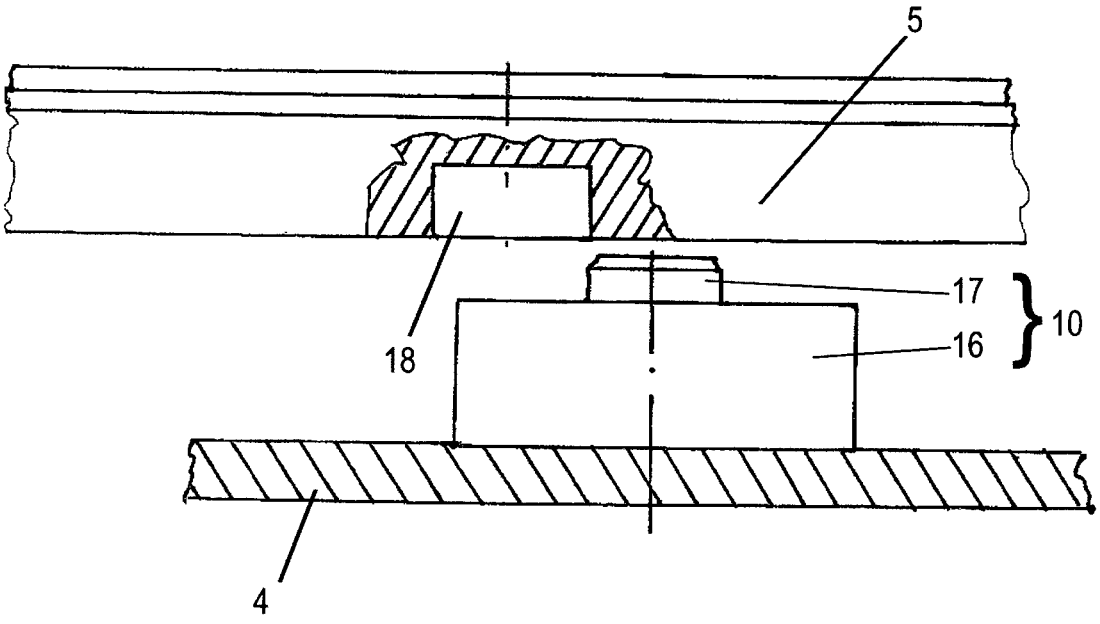
FIG. 6 shows in a schematic diagram a partial section through the foot switch according to FIG. 5 with released horizontal movement in a horizontally actuated state.

In FIGS. 5 and 6, a part of a foot switch is shown as a second embodiment example. In FIGS. 5 and 6, a pedal base body 4, a pedal pivot body 5 and a locking device 10 can be seen from the foot switch. Similar to the embodiment example in FIGS. 1 to 4, the pedal base body 4 is mounted on a housing assembly not visible here so that it can pivot about a horizontal axis and the pedal pivot body 5 is mounted so that it can pivot to the sides about an axis perpendicular to the pedal base body 4. As in the first embodiment example, the foot switch is thus designed as a multi-way pedal switch.

The locking device 10 has a locking piston 17, which can be moved to a release position and a locked position by means of an actuator 16. FIG. 5 shows the locked position, in which the lateral pivoting movement of the pedal pivot body 5 is arrested by the locking piston 17 being retracted into a blind-hole-shaped receptacle 18 of the pedal pivot body 5. FIG. 6 shows the arrangement in the release position of the locking piston 17 with pivoted pedal pivot body 5.

The locking piston 17 can be operated by the actuator 16 in an electromagnetic, electromotive or any other suitable way. The actuation can be triggered manually by a switch not shown here attached to the foot switch, manually by a separate remote-control unit or manually or automatically by remote control from the controlled device. The locking state is signaled by the detection of the actuation signal applied to actuator 16 or by a suitable sensor arrangement detecting the position of the locking piston 17.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 Foot switch
2 Housing assembly
3 Pedal assembly
4 Pedal base body
5 Pedal pivot body
6 Foot rest
10 Locking device
11 Hand lever
12 Locking pin
13 Locking pin chamber
14 Permanent magnet

15 Reed switch
16 Actuator
17 Locking piston
18 Receptacle

The invention claimed is:

1. A foot switch, comprising:

at least one pedal, which is pivotally mounted for actuation about at least two axes arranged at an angle relative to one another; and a locking device configured to lock movement of the pedal about one of the at least two axes, wherein the locking device is controllable, wherein the locking device has an actuator with which a locking element can be moved into a locking position and a release position, and wherein the actuator moves the locking element electromagnetically or electromotively.

2. The foot switch of claim 1, further comprising:

a pedal base body pivotally mounted about a horizontal axis; and a pedal pivot body pivotally mounted relative to the pedal base body about an axis perpendicular to the pedal base body, wherein the at least two axes include the horizontal axis and the axis perpendicular to the pedal base body.

3. The foot switch of claim 2, wherein the locking device acts on the pivoting movement of the pedal pivot body relative to the pedal base body.

4. The foot switch of claim 1, wherein the locking element is locking piston.

5. The foot switch of claim 1, wherein the locking device has a sensor arrangement to detect a locking state.

6. The foot switch of claim 5, wherein the sensor arrangement comprises a permanent magnet and a reed switch.

7. A foot switch, comprising:

at least one pedal, which is pivotally mounted for actuation about at least two axes arranged at an angle relative to one another;

a locking device configured to lock movement of the pedal about one of the at least two axes;

a pedal base body pivotally mounted about a horizontal axis; and a pedal pivot body pivotally mounted relative to the pedal base body about an axis perpendicular to the pedal base body, wherein the at least two axes include the horizontal axis and the axis perpendicular to the pedal base body, wherein the locking device is manually operable, wherein the locking device comprises at least one hand lever coupled to at least one locking pin, wherein the locking pin blocks the pivoting movement of the pedal pivot body in a locking position and enables the pivoting movement in a release position, wherein the at least one locking pin is retracted in the release position into a locking pin chamber of the pedal pivot body and is extended in the locking position from the locking pin chamber to such an extent that the at least one locking pin acts as a stop relative to the pedal base body, and wherein the at least one locking pin includes two locking pins arranged in such a way that in the locking position the two locking pins each rest against one side of the pedal base body.

* * * * *